United States Patent [19]

Blake

[11] Patent Number: 4,699,301

[45] Date of Patent: Oct. 13, 1987

[54] TWO PIECE DISPENSING CLOSURE

[76] Inventor: William S. Blake, 14 Georgetown Ct., Linwood, N.J. 08221

[21] Appl. No.: 4,821

[22] Filed: Jan. 12, 1987

Related U.S. Application Data

[63] Continuation of Ser. No. 791,424, Oct. 25, 1985, abandoned.

[51] Int. Cl.[4] ..... B65D 47/00

[52] U.S. Cl. ..... 222/546; 222/556; 215/235

[58] Field of Search ..... 215/235, 237, 239; 220/339; 425/DIG. 57; 264/138, 157, 297.2; 222/206, 212–213, 478, 491, 494, 517–518, 538, 544–546, 563, 567

[56] References Cited

U.S. PATENT DOCUMENTS

| | | | |
|---|---|---|---|
| 3,772,715 | 11/1973 | Nigro | 4/228 |
| 3,774,756 | 11/1973 | Carlile et al. | 264/297.2 X |
| 4,291,818 | 9/1981 | Nozawa et al. | 220/335 |
| 4,399,928 | 8/1983 | Klingler | 215/237 X |
| 4,420,101 | 12/1983 | O'Neill | 222/212 |
| 4,569,464 | 2/1986 | Wassilieff | 222/529 |

FOREIGN PATENT DOCUMENTS

| | | | |
|---|---|---|---|
| 760292 | 10/1956 | United Kingdom | 222/546 |

*Primary Examiner*—Joseph J. Rolla
*Assistant Examiner*—Michael S. Huppert
*Attorney, Agent, or Firm*—Dennis H. Lambert

[57] ABSTRACT

A two-piece dispensing closure in which a relatively soft inner seal member is positioned beneath a rigid outer closure member. The inner seal member effects a seal between the outer member and the neck of the container, and enables the parts to be snapped together. Further, the closure may be snap fitted to the container, which may have either an injection blow molded neck finish or an extrusion blow molded neck finish. In one form of the invention, a pivoted plug is carried by the outer member for insertion in an opening formed in the inner member. In another form of the invention, the plug is fixed relative to the outer member and the inner member flexes relative thereto. In a still further form of the invention, the outer member has a valve seat and the flexible inner member carries a plug for cooperation with the seat.

The method of making a two-piece dispensing closure is also disclosed, in which a plug member is molded integrally with a closure member and then separated therefrom along frangible breakaway connections for subsequent assembly to the closure.

11 Claims, 23 Drawing Figures

TWO PIECE DISPENSING CLOSURE

This application is a continuation of application Ser. No. 791,424, filed 10/25/85, abandoned.

DESCRIPTION

1. Technical Field

This invention relates to container closures, and more particularly, to dispensing closures for squeeze bottles. The closure has an opening through which product is dispensed when the container is squeezed, and a plug member insertable into the opening to prevent flow through the opening.

2. Background Art

In the packaging of various materials, ranging from personal care products such as shampoo, lotions and soaps, to household products, foods and medicines, many different package designs have evolved. All such packages are desirably capable of economical production in large quantities and also are preferably attractive in appearance and easy to use.

One popular package design is the squeeze bottle or flexible container which is squeezed to cause dispensing of the product. Such packages are provided with a variety of closures, including flip-up valves or plugs which must be manually opened and closed. Such closures are typically threaded onto a container and are of one-piece design, or are molded as two separate pieces and then assembled. The type of neck ring finish which may be used with these closures is limited, and when they are molded as two separate pieces extra molds are required. Additionally, because of the design of such closures relatively complex molds must be used.

DISCLOSURE OF THE INVENTION

Applicant has discovered an improved dispensing closure for squeeze bottles, in which a flexible inner valving member is assembled to a container with a rigid outer valving member. The flexible inner valving member is made of a relatively soft plastic material which effects a secure seal between the closure and the container and eliminates the need to use a threaded fitting between the closure and container. The rigid outer valving member has an integrally molded valve plug adapted to extend into an opening in the flexible inner valving member to preclude flow through the closure.

The unique closure of the invention may be easily molded in simple, straight draw type molds, and in one form of the invention has a hinged plug which is molded integrally with the body of the closure and then broken away for subassembly in a pivot pocket, eliminating the need for separate molding steps in the production of the plug member. In other forms of the invention, the plug is integrally molded with a living hinge structure in which reinforcing ribs are provided to insure positive action of the hinge throughout the expected life of the dispensing closure. Interengaging detent means are provided on the hinge or pivot area of these closures to assist in maintaining the plug in an open position when desired.

A further form of the invention has a fixed plug carried by the rigid outer valving member and a movable diaphragm type valve closure on the inner flexible member. A removable pressure sensitive seal is adapted to be secured over the outer rigid valving member to prevent leakage of product from the container in the event of inadvertent pressure on the container.

A still further form of the invention has a port in the rigid outer valving member and a valve plug or head is carried by the inner flexible valving member such that pressure on the container causes the diaphragm of the inner member to flex and open the valve from the port. Release of pressure from the container enables the natural resiliency or memory of the diaphragm to once again seat the valve plug in the opening.

All forms of the invention may be used with injection blow molded or extrusion blow molded neck ring finishes on the containers, and the closures may be rapidly and economically produced in large numbers. Further, assembly of the closures is easy.

BRIEF DESCRIPTION OF THE DRAWINGS

These and other objects and advantages of the invention will become apparent from the following detailed description and accompanying drawings, in which like reference characters designate like parts throughout the several views, and wherein.

BEST MODE FOR CARRYING OUT THE INVENTION

Figure 2:
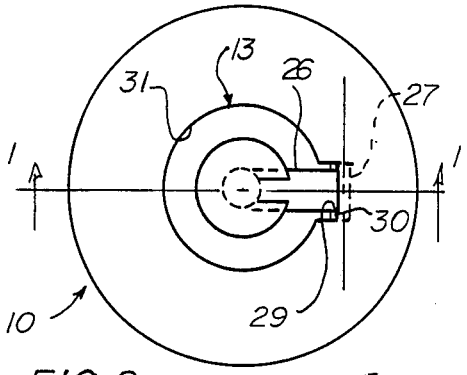
FIG. 2 is a top plan view of the closure of FIG. 1.
Figure 8:
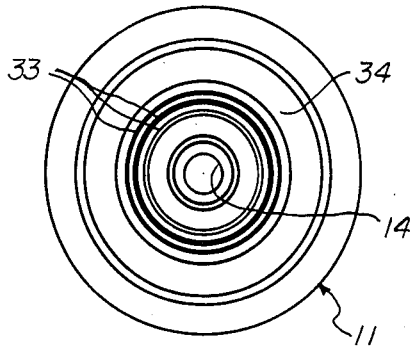
FIG. 8 is a top plan view of the member of FIG. 6.
Figure 1:
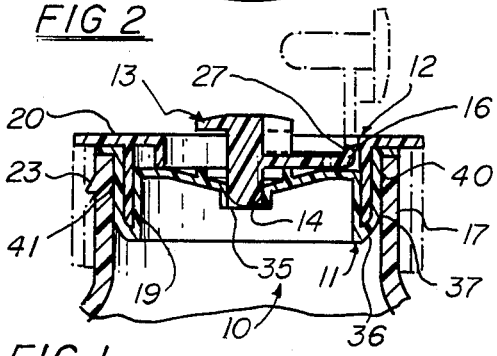
FIG. 1 is a vertical sectional view of a first form of dispensing closure according to the invention, shown assembled to the neck of a container.
Figure 6:
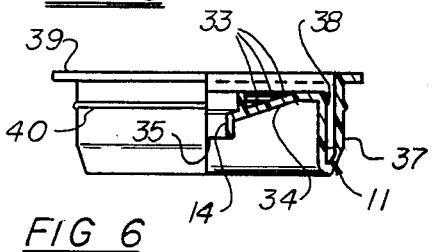
FIG. 6 is a composite view of the inner flexible valving member of the closure of FIG. 1, showing the member in elevation in the left hand side of the figure and in section in the right hand side.

Referring more specifically to the drawings, a first form of dispensing closure in accordance with the invention is indicated generally at 10 in FIGS. 1 through 8. The dispensing closure 10 is essentially a two-piece device and is molded as two parts, including a relatively soft valving member and seal 11 and a rigid outer valving member and closure 12. However, a pivoted valve plug or seal 13, adapted to be swung or pivoted into and out of closing relationship with a central opening 14 through the inner member 11 is molded as an integral part of the outer member 12 and is thereafter broken away along frangible points of connection 15 and then positioned as part of a subassembly in a pivot pocket 16 formed between the inner and outer members prior to assembly of the closure to the neck 17 of a container. This method of construction enables the closure to be manufactured as a two piece device, even though the valve plug actually comprises a third part in the final assembly.

Figure 4:
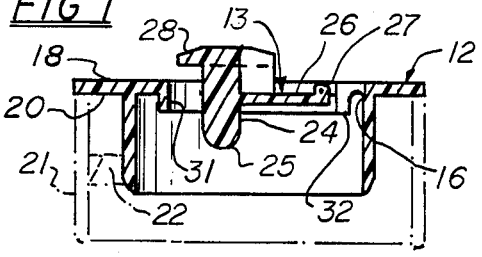
FIG. 4 is a vertical sectional view of the rigid valving member of the closure of FIG. 1, showing the member as molded.
Figure 7:
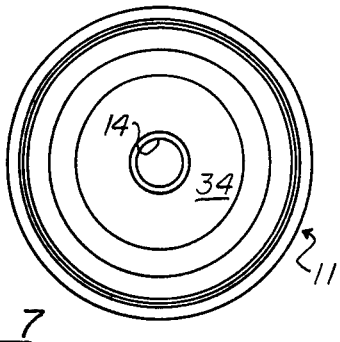
FIG. 7 is a bottom plan view of the member of FIG. 6.
Figure 3:
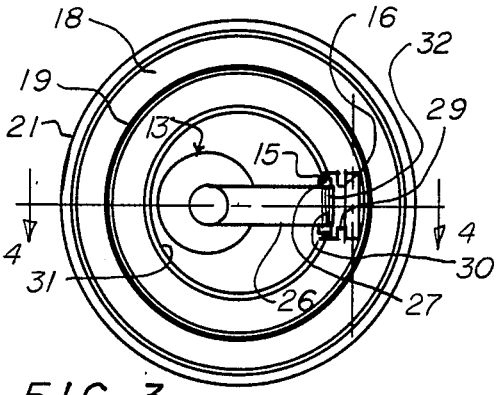
FIG. 3 is a bottom plan view of the closure of FIG. 4, as molded.
Figure 5:
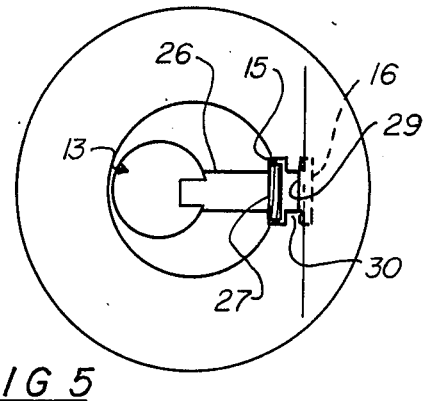
FIG. 5 is a top plan view of the member of FIG. 4.
Figure 10:
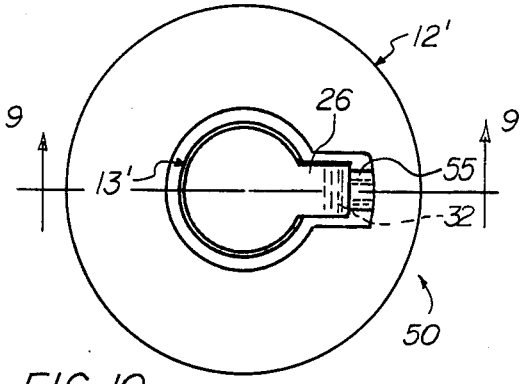
FIG. 10 is a top plan view of the closure of FIG. 9.
Figure 15:
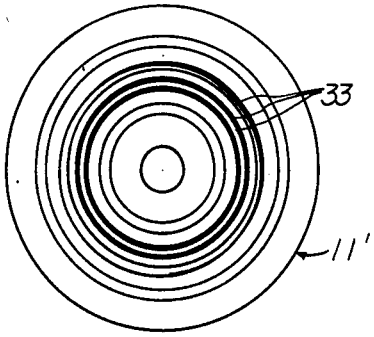
FIG. 15 is a top plan view of the member of FIG. 13.
Figure 9:
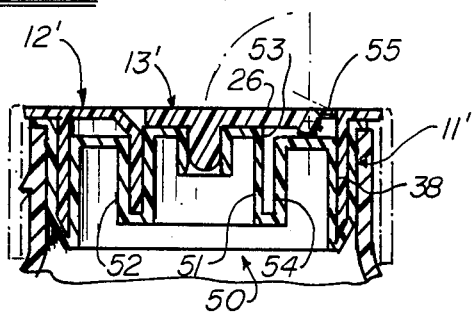
FIG. 9 is a vertical sectional view of a first modification of the invention, in which a web type living hinge is integrally molded with the plug.
Figure 13:
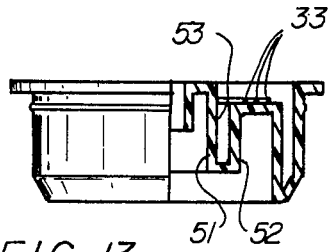
FIG. 13 is a composite view similar to FIG. 6, of the flexible closure member of FIG. 9, showing the member in elevation in the left hand side of the figure and in section in the right hand side.
Figure 12:
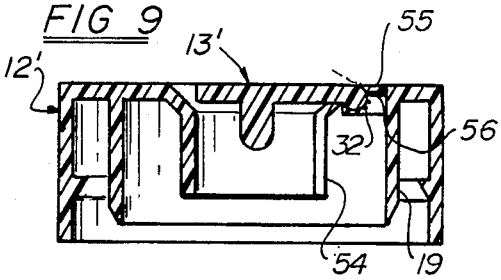
FIG. 12 is a vertical sectional view of the rigid member of the closure of FIG. 9.
Figure 14:
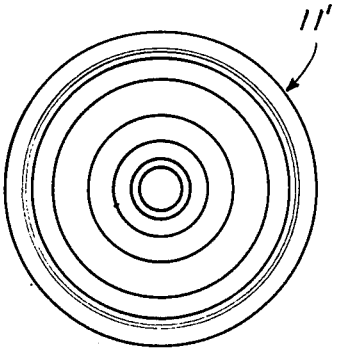
FIG. 14 is a bottom plan view of the member of FIG. 13.
Figure 11:
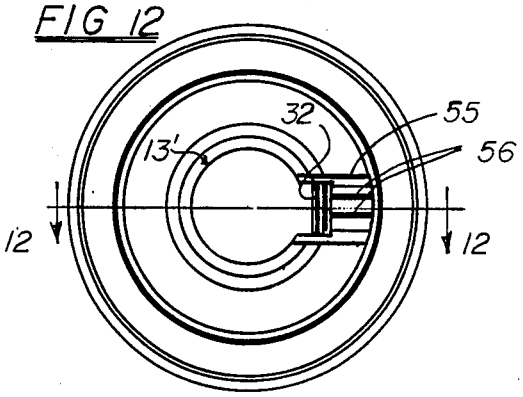
FIG. 11 is a bottom plan view of the closure of FIG. 9.

As seen in FIGS. 3 and 4, the rigid outer member 12, as molded, comprises a disc-shaped end wall 18 having a depending cylindrical skirt 19 spaced inwardly from the outer marginal edge of the end wall 18, whereby a narrow annular flange 20 is defined, extending past the skirt 19. If desired, a second depending cylindrical skirt 21 may be provided at the outer marginal edge of the end wall, as shown in dot-and-dash lines in FIGS. 1 and 4. This skirt 21 may constitute a false skirt which performs only a decorative function, or it may have a retaining bead 22 for cooperation with a transfer bead 23 on the neck of the container to retain the closure on the container or assist in retaining the closure on the container. In addition, the valve plug 13 is molded integrally with the outer member 12, and comprises a sealing portion 24 having a rounded nose 25 for insertion into the opening 14 of the inner member 11, a pivot arm 26 with a slightly enlarged and rounded heel 27, and an enlarged head 28 to facilitate grasping of the plug to open it during use. The plug is molded to the end wall 18 at the frangible breakaway points 15 on opposite sides of the heel 27. The recessed pivot pocket 16 is molded in the underside of the end wall 18 just inside the skirt 19, and a cut-out 29 is formed in one wall 30 defining the pivot pocket to provide clearance for the pivot arm 26 when the plug 13 is in its open position as shown in dot-and-dash lines in FIG. 1. The end wall 18 is also molded with a large central opening 31 around the plug 13. The underside of the heel 27 is serrated or knurled at 32 for cooperation with gripper rings 33 on the adjacent surface of the inner member 11 to retain the plug in an open position.

The inner member 11 has an end wall 34 which, when assembled with the outer member, extends beneath the end wall 18 of the outer member. The opening 14 is formed through the center of the end wall 34 in registry with the plug 13, and is defined in part by a short depending sleeve or cylindrical seat 35 to assure a positive seal with the plug. A pair of closely spaced depending cylindrical walls 36 and 37 are formed at the outer edge of the wall 34 and define an upwardly open channel 38 which receives the skirt 19. A short annular flange 39 extends outwardly from the upper edge of the outer cylindrical wall 37 and forms a gasket underlying the flange 20 of the outer member, for effecting a secure seal with the neck of the container. A combined seal and retention bead 40 is formed on the outer surface of the wall 37 for sealing engagement with the inner surface of the neck 17, and if desired, engagement in a groove 41 in the neck surface to retain the closure on the neck.

In those instances when relatively viscous product is to be dispensed, the neck can be made large in diameter, and both the inner retention structure and outer retention structure provided. Ordinarily, the closure can be secured on the neck with only the inner retention structure when less viscous products are to be dispensed.

The neck 17 may be either injection blow molded of extrusion blow molded for used with the closure of the invention. Moreover, a container formed by a combination of these manufacturing methods may be used when it is desired to have an injection molded neck finish but a flatter shape to the container is desired.

The closure according to the invention may thus be economically produced in large numbers, and assembly is easily accomplished by snap-fitting the parts together and to a container. Of course, the parts may be made for threaded engagement with a container if desired.

A first modification of the invention is indicated generally at 50 in FIGS. 9 through 15. This form of the invention differes from that disclosed in FIGS. 1 through 8 in that the inner seal member 11' includes a second pair of depending cylindrical walls 51 and 52 defining an upwardly open channel 53 spaced inwardly from the first channel 38 for receiving a second depending cylindrical wall 54 on the outer closure member 12' for reinforcing and strengthening the dispensing closure, and in that the plug 13' is integrally molded to the closure 12' via a living hinge 55 at the heel of the plug pivot arm 26. One or more ribs 56 are molded into the hinge 55 to increase its strength and durability. In all other respects, this form of the invention is the same as previously described.

Figure 16:
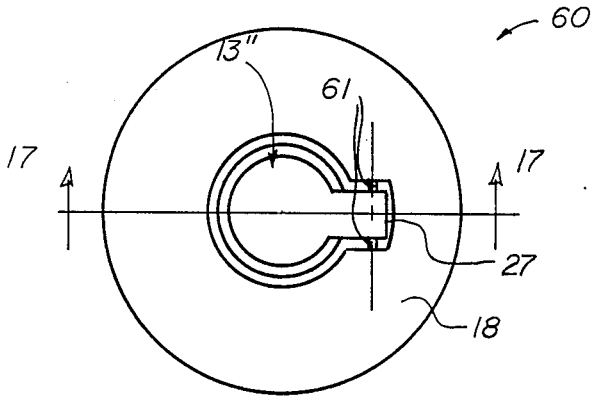
FIG. 16 is a top plan view of a second modification of the invention, wherein the hinge comprises integrally molded torque pins.
Figure 17:
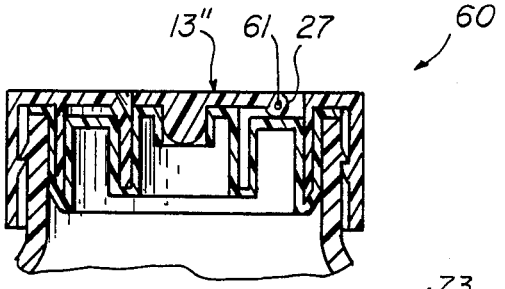
FIG. 17 is a vertical sectional view taken along line 17—17 in FIG. 16.

A second modification of the invention is indicated generally at 60 in FIGS. 16 and 17. This form of the invention is the same as that described in FIGS. 9 through 15 except that rather than the web-type living hinge 55, a pair of torque arms 61 are molded at the heel 27, joining the arm 26 to the end wall 18 on opposite sides of the heel. In use, the plug is lifted upwardly against the torque of these arms, which twist about their axes.

Figure 18:
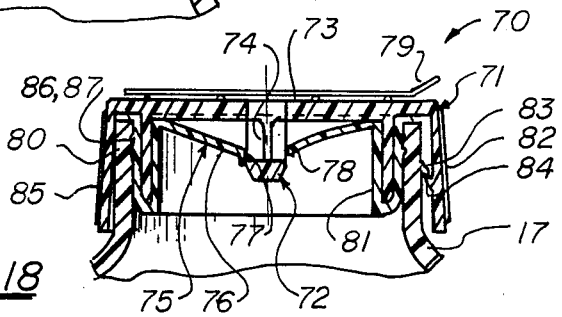
FIG. 18 is a vertical sectional view of a third modification of the invention, wherein the plug carried by the outer rigid member is fixed and the inner flexible valving member moves relative thereto.
Figure 20:
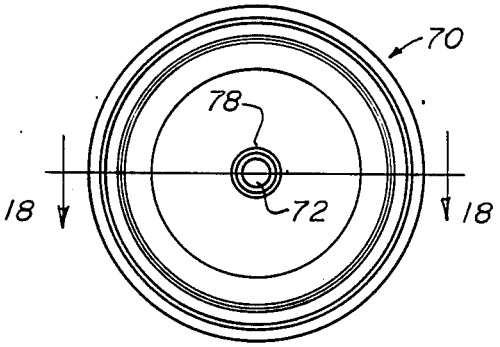
FIG. 20 is a bottom plan view of the invention of FIG. 18.
Figure 19:
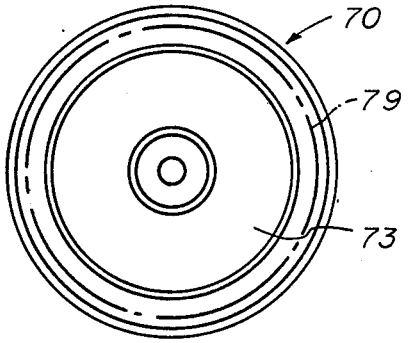
FIG. 19 is a top plan view of the invention shown in FIG. 18.

A third modification of the invention is shown generally at 70 in FIGS. 18 through 20. In this form of the invention, the outer member 71 carries an integrally molded fixed plug 72 which projects downwardly from the center of the end wall 73. A plurality of ports 74 are formed through the plug side wall for flow of product.

A flexible inner valving member 75 comprises a diaphragm wall 76 with a central opening 77 therethrough surrounded by a sealing lip 78. Normally, in the absence of pressure on the container the parts are in the closed position as shown in the left hand side of FIG. 18, but when pressure is exerted on the contents of the container by squeezing the container, pressure of the product acts on the diaphragm to move it upwardly and unseat the sealing lip 78 from the nose or seat on the end of the plug 72 as shown in the right hand side of FIG. 18.

A pressure sensitive seal 79 may be provided for disposition in closing relation over the end wall 73 to prevent inadvertent leakage of product during shipment, etc.

The inner and outer members of this form of the invention have interfitting depending cylindrical walls 80 and 81 which extend in close-fitting relationship inside the neck 17 of the container. This engagement normally effects a secure seal and retains the closure on the container, but a depending skirt 82 may be provided on the outer member 71 to depend in surrounding relation to the neck 17 and provide further means for retaining the closure on the container via interengaged ribs 83 and 84. This is shown in the right hand side of FIG. 18. A false skirt 85 may be provided as shown in the left hand side of this figure.

As seen best in FIG. 18, interengaged sealing and retention rings and grooves 86 and 87 are provided on the mating surfaces of the wall 80 and neck 17.

Figure 21:
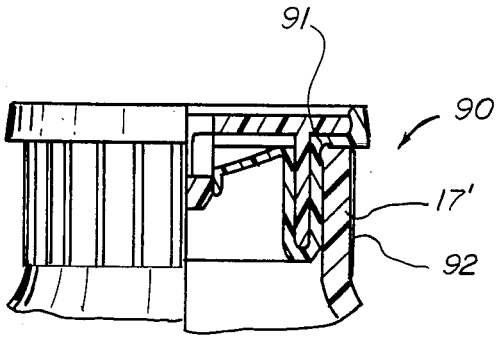
FIG. 21 is a vertical sectional view similar to FIG. 18 of a fourth modification of the invention.

A fourth modification of the invention is shown at 90 in FIG. 21, and this form of the invention is identical to that shown in FIGS. 18 through 20 except that an injection blow molded bead 91 is formed on the upper inner surface of the neck 17' to retain the closure on the container. The outer surface of the neck 17' may be provided with a decorative finish as at 92, if desired.

Figure 22:
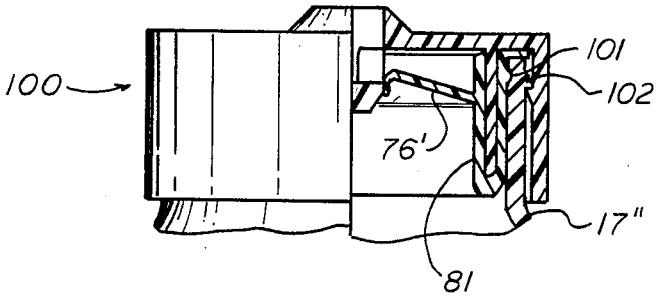
FIG. 22 is a view similar to FIG. 21 of a fifth modification of the invention.

A fifth modification of the invention is shown at 100 in FIG. 22. This form of the invention is similar to that shown in FIGS. 18 and 21, except that both an injection blow molded groove 101 and a transfer bead 102 are formed in the neck 17'' of the container. Further, the diaphragm will 76' is joined at its outer edge farther down on the wall 81, whereby the diaphragm has a reverse angle from that shown in FIG. 18.

Figure 23:
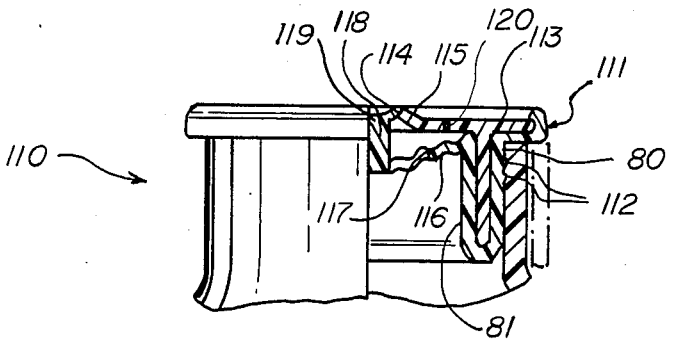
FIG. 23 is a view similar to FIG. 21 of a sixth modification of the invention.

A sixth modification of the invention is shown at 110 in FIG. 23. In this form of the invention, the neck has an extrusion blow molded finish and the wall 80 on the inner flexible member 111 may have a double seal 112 with the inner surface of the neck. Rather than carrying a fixed valve plug as in the form shown in FIG. 21, the end wall 113 has a central opening 114 therethrough, with a slightly upwardly flared seat 115 surrounding the opening. The flexible diaphragm wall 116 is formed as a concentric bellows diaphragm, with a plurality of openings 117 through the center portion thereof and a valve plug 118 carried at the center of the diaphragm in a position to extend upwardly through the opening 114. The valve plug 118 has an enlarged head 119 which normally is urged downwardly into sealing engagement with the seat 115 by the bias of the diaphragm. However, when pressure is exerted on the container, the pressure forces the diaphragm upward and opens the valve.

Although not specifically described in connection with each form of the invention disclosed herein, it should be noted that all of the forms will have a vent means for admitting air to the container to replace the volume of dispensed product. For example, a vent opening 120 can be formed through the end wall of the outer member in those forms of the invention illustrated in FIGS. 18 through 23. In the remaining forms having a movable plug, the product outlet opening itself comprises the vent.

While the invention has been illustrated and described in detail herein, it is to be understood that various changes in construction and operation can be made without departing from the spirit thereof as defined by the scope of the claims appended hereto.

I claim:

1. A two-piece dispensing closure for squeeze containers, comprising:

a relatively soft inner seal member having an end wall with an opening therethrough for flow of product from the container, and having a pair of concentric cylindrical walls defining an annular channel therebetween, said inner member comprising a seal for sealing the closure to the container;

a relatively rigid outer member having an end wall overlying the end wall of the inner seal member and having an opening therethrough for flow of product form the container, and having a cylindrical wall extending snugly into the channel of the inner member, defining a tortuous area of contact between the inner and outer members to effect a seal therebetween and to hold them together in assembled relationship;

plug means carried by one of said inner and outer members in a position to extend into the opening in the other member when in a closed position to preclude flow of product from the container, said plug means and said other member being displaceable relative to one another to remove the plug means from the opening and permit flow of product from the container through the opening; and said concentric cylindrical walls being arranged to fit snugly inside the neck of the container to secure the closure to the container and effect a seal therewith.

2. A dispensing closure as in claim 1, wherein:

the plug means is molded integrally with the rigid outer closure member.

3. A dispensing closure as in claim 2, wherein:

the plug means is pivoted to the end wall of the outer closure member.

4. A dispensing closure as in claim 3, wherein:

the plug means is pivoted to the closure member via a living hinge molded integrally with the plug means and closure end wall.

5. A dispensing closure as in claim 3, wherein:

the plug means is separate fromt he outer closure member and has a pivot arm, said pivot arm having one end thereof pivotally received in a pivot pocket defined between the inner and outer members.

6. A dispensing closure as in claim 4, wherein:

said one end of the pivot arm and an adjacent portion of the inner seal member have interengaged roughened surface means to retain the plug means in an open position.

7. A dispensing closure as in claim 4, wherein:

the plug means is includes a pivot arm having a heel end joined to t he living hinge, and interengaged roughened surface means on the heel end and the adjacent inner seal member to retain the plug means in an open position.

8. A dispensing closure as in claim 4, wherein:

reinforcing ribs are formed on the living hinge to increase its strength and durability.

9. A dispensing closure as in claim 2, wherein:

the plug means has a free end and an end fixed to the end wall of the outer member and has flow ports formed through the side thereof, defining a valve seat to at the free end; and said inner seal member end wall comprises a diaphragm, said opening being formed through the diaphragm and being circumscribed by a sealing lip, said sealing lip normally engaged with said valve seat on the plug to preclude product flow, and being moved along said plug away from the seat to enable product flow upon pressurization of the contents of the container.

10. A dispensing closure as in claim 9, wherein:

a pressure sensitive seal is secured over the closure end wall to prevent leakage of product therefrom.

11. A dispensing closure as in claim 1, wherein:

the plug means is carried by the inner, relatively soft seal member, and the end wall of the inner member comprises a diaphragm responsive to pressure thereon to unseat the plug means from the opening.

* * * * *